United States Patent [19]

Evans

[11] Patent Number: 4,856,433

[45] Date of Patent: Aug. 15, 1989

[54] INITIATOR DEVICE WITH ADIABATIC COMPRESSION IGNITION

[75] Inventor: Griffith S. Evans, Westmont, Ill.

[73] Assignee: Scot, Incorporated, Downers Grove, Ill.

[21] Appl. No.: 72,561

[22] Filed: Jul. 13, 1987

[51] Int. Cl.[4] ..... F42B 5/20

[52] U.S. Cl. ..... 102/530; 102/204

[58] Field of Search ..... 102/530, 531, 204

[56] References Cited

U.S. PATENT DOCUMENTS

| | | | |
|---|---|---|---|
| 3,726,220 | 4/1973 | MacDonald | 102/530 |
| 3,972,287 | 8/1976 | Travor | 102/530 |
| 4,099,465 | 7/1978 | Haake | 102/204 |
| 4,135,454 | 1/1979 | Morris | 102/205 |
| 4,231,282 | 11/1980 | Ashley | 89/7 |
| 4,406,229 | 9/1983 | Greene et al. | 102/530 |
| 4,429,632 | 2/1984 | Yunan | 102/202.13 |
| 4,617,866 | 10/1986 | Simpson | 102/262 |
| 4,646,644 | 3/1987 | Richmond | 102/530 |

*Primary Examiner*—Donald P. Walsh

*Attorney, Agent, or Firm*—Mann, McWilliams, Zummer & Sweeney

[57] ABSTRACT

An initiator device for activating air crew escape systems comprising a housing of elongate cylindric configuration defining a central chamber having a propellant gas discharge bore at one end and being open at the other end for receiving and static pressure mounting in the central chamber a pyrotechnic cartridge that is held in mounted position by a separate screw threaded head screw threadedly mounted in the housing open end, with the cartridge including a metallic body defining a compression chamber having at the portion of same that is engaged by the housing head, and having a piston received in the compression chamber that is frangibly secured to the cartridge body; the cartridge body also defines a separate pyrotechnic material receiving chamber that is open to the body compression chamber with a column of suitable pyrotechnic materials, tailored in light of the job to be done by the initiator, being mounted in the pyrotechnic material receiving chamber having a head end and terminating with an initiator pressure propellant charge, the initiator device head being formed and mounted, for driving the cartridge piston across the cartridge compression chamber to ignite by adiabatic compression the head end of pyrotechnic column contained in the cartridge, whereby on ignition of the propellant charge, the initiator activates air crew escape systems.

15 Claims, 4 Drawing Sheets

INITIATOR DEVICE WITH ADIABATIC COMPRESSION IGNITION

This invention relates to an initiator device for activating emergency equipment, such as air crew escape systems aboard aircraft, space craft, and/or launch vehicles, and more particularly, to an initiator device for the purpose indicated that is of the pyrotechnic type for generating the propellant pressure gas activator, and that is ignited by adiabatic compression.

Emergency equipment activators have heretofore taken the form of "initiators" involving pyrotechnic materials that are initially ignited to effect ignition of the propellant output charge that generates a gaseous flow under high pressure that is conveyed through hosing or the like to the emergency equipment to be activated for activating same. The initiators themselves are actuated in a number of different ways, for instance, mechanically, electrically, and explosively, depending on the nature of the initiator involved, the environment in which it is to be operated under emergency conditions, the nature of the emergency equipment to be activated thereby, and the availability to personnel of the particular initiator device involved for setting it into operation, as well as the time frame in which the emergency equipment must be rendered operative after the initiator has been placed in operation.

The pyrotechnic materials used in initiators are ordinarily arranged in a column within the initiator, which column includes at its head end pyrotechnic powders and the like of maximum ignitability characteristics, that are exposed to the source of heat provided by the initiator, with the pyrotechnic column of the initiator ending at the propellant output charge that is of low ignition characteristics, but may profusely generates gas at high pressure when ignited, or be explosive, for transmittal to the emergency equipment to be actuated (through hosing or other suitable conduiting) the kinetic energy required to actuate same. Initiators may be of the short span ignitor type, in which full ignition is occurred in up to about 0.010 seconds, or initiators may be of the time delay type in which full ignition is delayed 30.0 seconds or more.

A principal object of the present invention is to provide an initiator for activating emergency equipment of the type indicated, which may be either of the short time span ignition type or the time delay ignition type, and in which the pyrotechnic materials applied in same are ignited by adiabatic compression with the head of the pyrotechnic column involved being exposed for ignition where the heat achieved by the adiabatic compression involved is of the highest temperature.

Another principal object of the invention is to provide an initiator for activating emergency equipment of the type indicated, in which the initiator is equipped with the usual output charge producing pyrotechnic column, that is contained in a cartridge assembly, together with a piston-compression chamber arrangement that is to effect ignition of the pyrotechnic materials involved utilizing adiabatic compression of the air or other suitable gase within the compression chamber, by forced activation and travel of the piston across the length of the cartridge assembly compression chamber for impact against the end of the compression chamber at which a pyrotechnic column begins.

Yet another principal object of the invention is to provide an initiator for activating emergency equipment that involves a housing which is or may be permanently installed and is adapted to removably receive a cartridge assembly that, when the initiator is activated, effects ignition of the pyrotechnic materials within the cartridge assembly and venting of for instance propellant pressure gases therefrom, into the conduiting that connects the initiator to the emergency equipment in question, so that a fired cartridge assembly can be replaced by a fresh cartridge assembly disposed within the initiator housing for repeated use of the initiating equipment involved without requiring replacement of the whole initiating system, or cartridge assemblies that have been in operating position for time periods that exceed the expected useful life of the cartridge assembly can be replaced by a fresh cartridge assembly.

Still another principal object of the invention is to provide a cartridge assembly, for application to housings of initiators for activating emergency equipment, that contains all that is needed to complete the initiator for full utility for activating emergency equipment, including the propellant charge for either pressure gas output or explosive output, the remaining pyrotechnic materials for igniting same, and an adiabatic compression ignition arrangement for igniting the pyrotechnic materials involved, the operation of which is effected by application to the initiator housing of a conventional form of explosive firing device, or exposing the initiator to a source of gas under pressure, such as a source of compressed air, which initiator may be pilot or crew man operated, or automatically operated, to effect initiator ignition.

Other objects of the invention are to provide an initiator for activating emergency equipment that is economical of manufacture, reliable and long lived in use, and when once used, avoids further use of the spent cartridge assembly involved while permitting simplified application to the initiator housing of a fresh cartridge assembly for in effect recharging the initiator, and that is arranged for safe packaging and shipping of the charged initiator when new.

Other objects, uses, and advantages will be obvious or become apparent from a consideration of the following detailed description and the application drawings.

IN THE DRAWINGS

However, it is to be distinctly understood that the specific drawing illustration provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Figure 1:
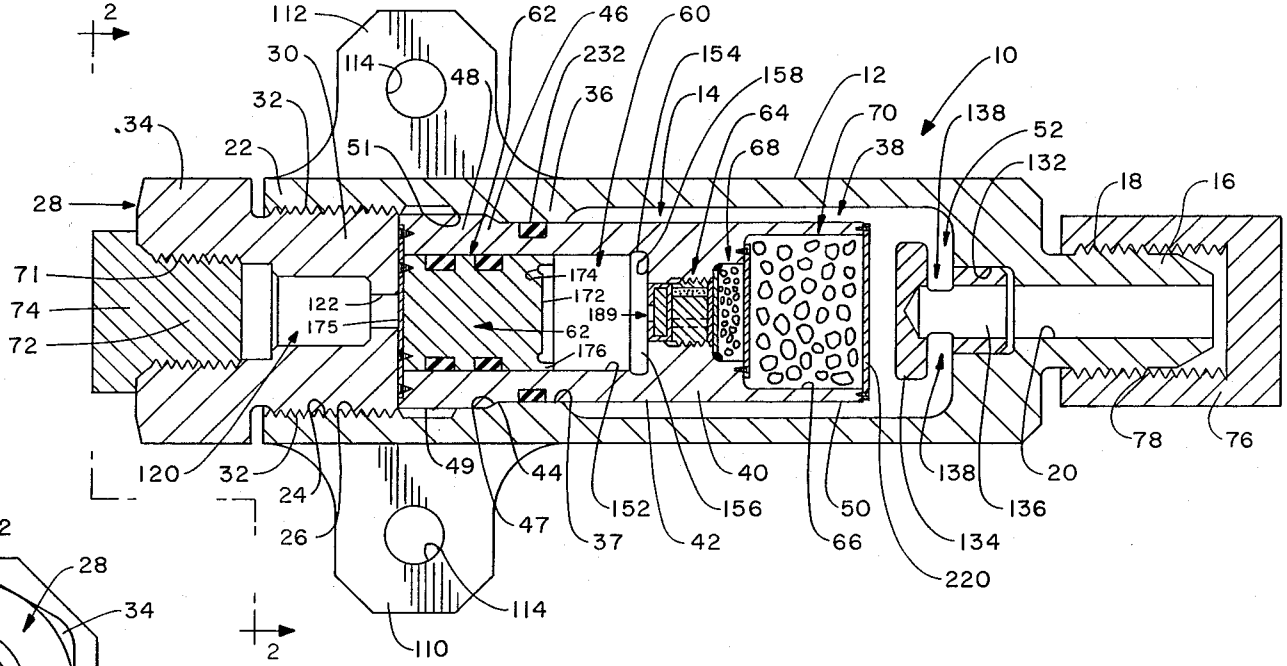
FIG. 1 is a longitudinal sectional view through an initiator arranged in accordance with the present invention, illustrating an initiator housing, cartridge assembly and head in the form in which the initiator may be packaged and shipped when new.
Figure 2:
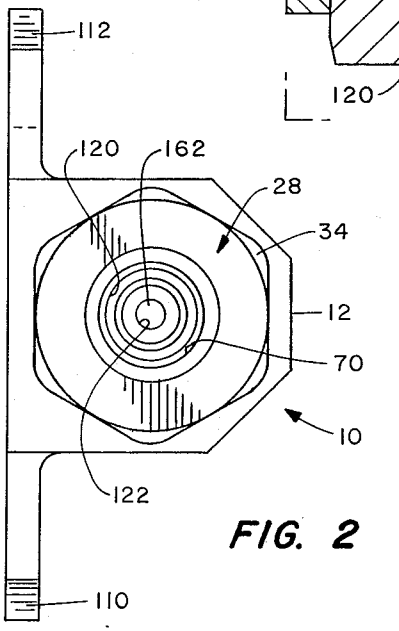
FIG. 2 is an end view of the initiator, taken substantially along line 2—2 of FIG. 1, but with the closure plug normally provided for packaging and shipping and shown in FIG. 1 omitted to expose parts beneath it.

Reference numeral 10 of FIGS. 1 and 2 generally indicates a preferred embodiment of the invention, in which the initiator 10 is shown as it would appear when duly assembled and made ready for shipment to customers.

As is well known in this art, initiator devices are widely used to activate emergency equipment involved in air crew escape systems carried aboard aircraft, space craft, launch vehicles, and the like. Many forms of emergency equipment are designed for actuation by, for instance, high pressure gas communicated thereto through tubing and emanating from an initiator device that is also part of the equipment aboard the aircraft, space craft, launch vehicle, or the like; the initiator is normally located adjacent a station or seat of the pilot or a designated crew man and is readily available for actuation, either explosively or otherwise, where emergency conditions are encountered. Initiator devices normally include a pyrotechnic column ending with a propellant output charge that, when ignited after initial ignition of the rest of the column, provides a high pressure gas that is communicated to the emergency equipment involved, for activating same, through appropriate conduiting or tubing connecting the initiator to the emergency equipment in question.

Prior initiator devices of the type indicated function through a positive action on the part of the pilot or crew man assigned to activate same to cause ignition of the pyrotechnic column of the initiator. Various ways have been proposed for effecting ignition of the initiator pyrotechnic materials, with it being proposed to effect the initiator ignition mechanically, electrically, or explosively, or combinations of same.

As is well known in the art, the composition of the pyrotechnic column employed in initiators depends considerably on the function to be served by the particular initiator device involved and the environment in which it is to operate. While initiators frequently have a relatively short time span ignition (up to about 0.010 seconds or less), including ignition of the gas producing propellant charge, initiators are also commonly provided with pyrotechnic columns arranged for time delay ignition characteristics, which effect full ignition of the gas producing propellant charge in up to 30.0 or more seconds.

Figure 8:
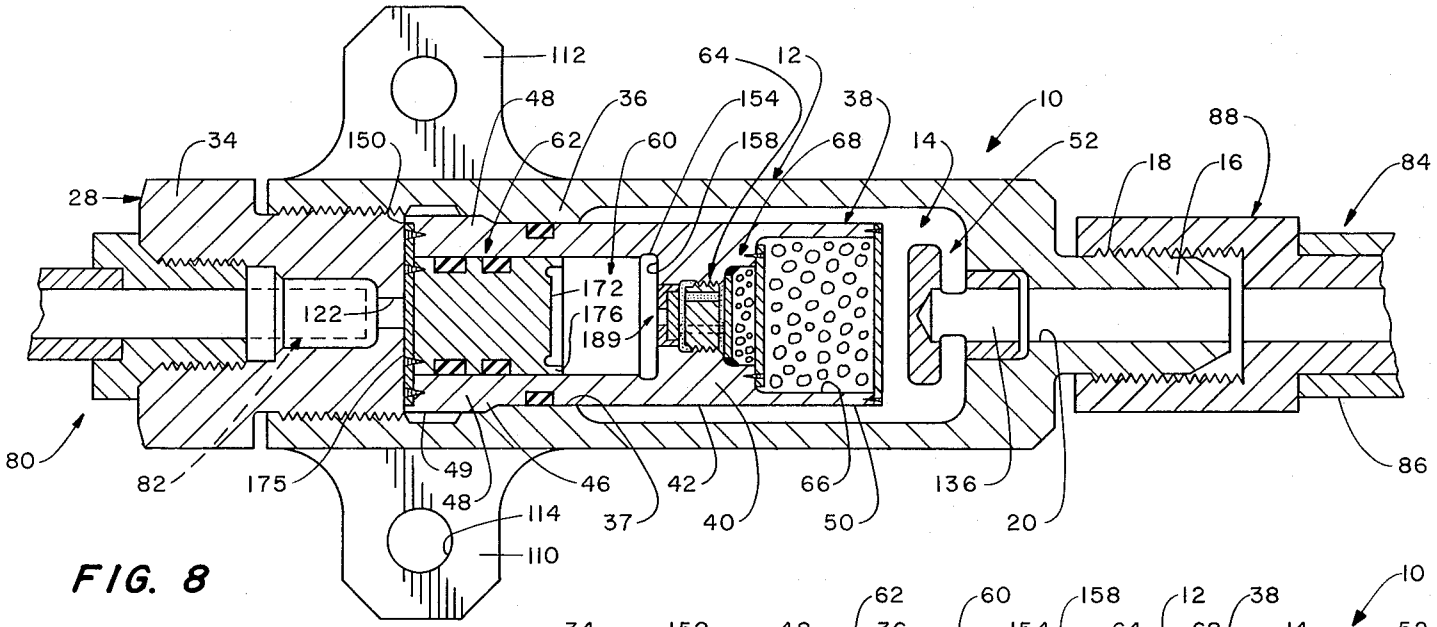
FIG. 8 is a view similar to that of FIG. 1, but showing the initiator device involved as installed and equipped for serving its initiator functions when explosively activated for this purpose by the pilot or crew man of, for instance, a space craft or aircraft to which the initiator is applied to activating emergency escape equipment.
Figure 9:
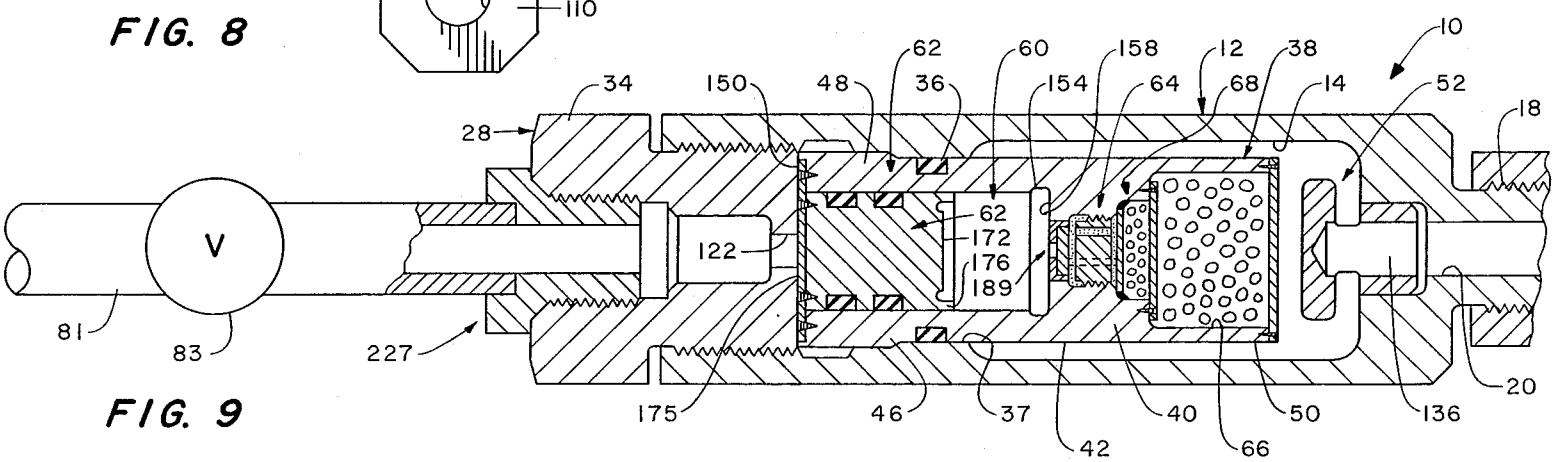
FIG. 9 is a view similar to that of FIG. 8, but showing the initiator device involved arranged to be activated for a high pressure gas source, with a portion of the discharge end of the initiator device broken away.

The initiator device 10 is shown in one embodiment in FIG. 1 as newly assembled and readied for shipment, while FIG. 8 shows the same initiator device 10 as it would be mounted in operative relation with respect to and disposed between a pilot or crew member actuable instrumentality for actuating the initiator, and conventional tubing or other conduiting that is to convey the high pressure gas produced by ignition of the propellant charge of the initiator to the emergency equipment for actuating same in one of the manners well known to the art; FIG. 9 shows the same initiator device 10 arranged for actuation from a high pressure neutral gas source.

Turning now more specifically to FIGS. 1 and 2, the initiator 10 comprises housing 12 of a generally cylindric configuration, formed from stainless steel or the like, defining a centrally located central chamber 14 and a discharge end 16 of reduced transverse cross-sectional configuration defining external threading 18, with the housing 12 defining a discharge bore or passage 20 that extends through discharge end 16. The opposite end 22 of housing 12 is open as indicated at 24 and internally threaded as indicated at 26 to receive a head 28 having an inner end 30 that is externally threaded as at 32 for threaded reception in the opening 26, and a head end 34 that may be of suitable hex shape for the application thereto of a suitable turning tool.

The housing 12 is internally formed to define annular internal shoulder 36 which also defines the open end 37 of the internal chamber 14 in which is mounted cartridge assembly 38.

The cartridge assembly 38 comprises body 40 that is also preferably formed from stainless steel or the like, and is also of cylindric configuration. The cartridge assembly body 40 defines external side surfacing 42 that is proportioned to be in slip fit but complementary relation to the housing shoulder opening 37, which surfacing 42 converges into an annular neck surfacing 44 defined by neck portion 46 of the body 40 that in turn merges into the cartridge body head end 48. The cartridge assembly body 40 defines discharge end 50 that is directed toward the discharge passage or outlet passage 20, with a deflector device 52 being disposed in fixed relation between the discharge end 50 of the body 40 and the discharge passage 20 of the housing 12 for avoiding blockage of outlet passage 20.

The cartridge assembly body 40 is formed to define a compression chamber 60 in which is lodged piston 62 that is frangibly connected to the body 40 when the cartridge assembly 38 is assembled for application to the housing 12. The cartridge assembly body 40 also defines pyrotechnic material receiving chamber 64, the shaping of which will depend on the pyrotechnic materials employed for the specific purpose served by initiator 10. In the cartridge assembly body 40 of assembly 30, body 40 includes an enlarged rearwardly disposed section 66, with the cartridge assembly 38 mounting pyrotechnic column 68 therein that includes suitable propellant charge 70 mounted in the chamber section 66. As brought out hereinafter, pyrotechnic column 68 and its charge 70 may be tailored to meet the specific needs of a specific initiator 10 or 100 and this will depend on where and how a specific initiator is to be used.

Figure 3:
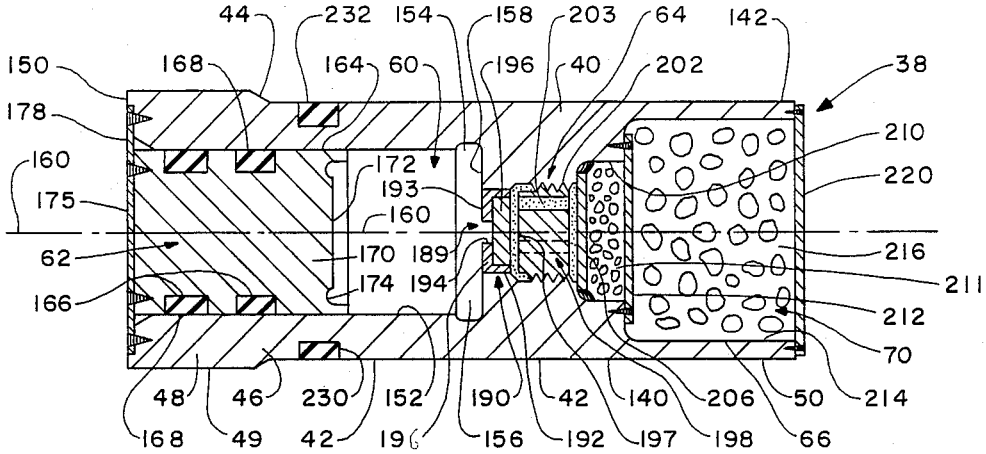
FIG. 3 is a longitudinal sectional view of the initiator cartridge assembly shown in FIG. 1, but on an enlarged scale, and diagrammatically illustrating the nature of a suggested pyrotechnic column that is part of the specific cartridge assembly illustrated.

When the initiator device 10 is assembled to place a cartridge assembly 38 within housing 12, the cartridge assembly 38 is arranged as indicated and pyrotechnic material equipped, in accordance with standard practices in this regard, in accordance with the needs that a specific initiator is to perform, which will govern the nature of the pyrotechnic column 68 employed, and thus dictate the shaping of the cartridge body 40 along the portion of same that is to house the column 68. Assuming the case of the specific cartridge assembly 38 of FIGS. 1 and 3 is involved, the cartridge assembly 38 is telescoped within the housing 12, from housing end 22 (when open), to bring its neck surfacing 44 in seated relation with the internal shoulder 36 of the housing 12. The initiator head 28 has its threaded end 30 ehtn turned into the threaded opening 24, and against the head 48 of the cartridge assembly body 40 to hold the cartridge assembly 38 mounted within the housing 12 in the manner indicated in FIG. 1 against dislodgement during shipment and mounting of the device 10 in its operative position in the aircraft involved.

The initiator head 28 is centrally bored and internally threaded as at 71 for several purposes. One is to receive the externally threaded end 72 of suitable plug 74 for packaging and shipping purposes, with the other end of the initiator 10, having applied to same a suitable cap 76 defining internal threading 78 that is threaded onto the housing reduced end portion 16. The plug 74 and cap 76 as applied to initiator 10 as shown in FIGS. 1 and 2 keep the initiator clean and dry until it is to be used.

When the initiator device 10 is to be armed and operably connected to the emergency equipment for activation of same, the plug 74 is removed from the head 28, and, if desired, to have a firing device of this type, replaced by a suitable conventional standard firing device, an example of which is the shielded mild detonating cord that forms the subject of Military Specification MIL-S-48405 dated October 15, 1973, or its equivalent with the SMDC involved being indicated by reference numeral 80 in FIG. 8, which conventional device 80 has the familiar explosive tip shown in dashed lines in FIG. 8 at 82. At the other end of the initiator device 10, conventional hosing 84 having a suitable conventional fitting applied to its end 86, where indicated at 88, is suitably threadly mounted on the external threading of the housing reduced end portion 16 to communicate the discharge passage or bore with the hosing 84 and thence to the equipment being activated when the initiator device 10 is brought into operation for this purpose.

FIG. 9 shows that initiator device 10 connected by suitable piping 81 and conventional off-on valve 83 to a source of neutral gas, such as air under high pressure (not shown) to activate device 10. The pressure of the neutral gas involved should be at least approximately 400 psig.

Figure 10:
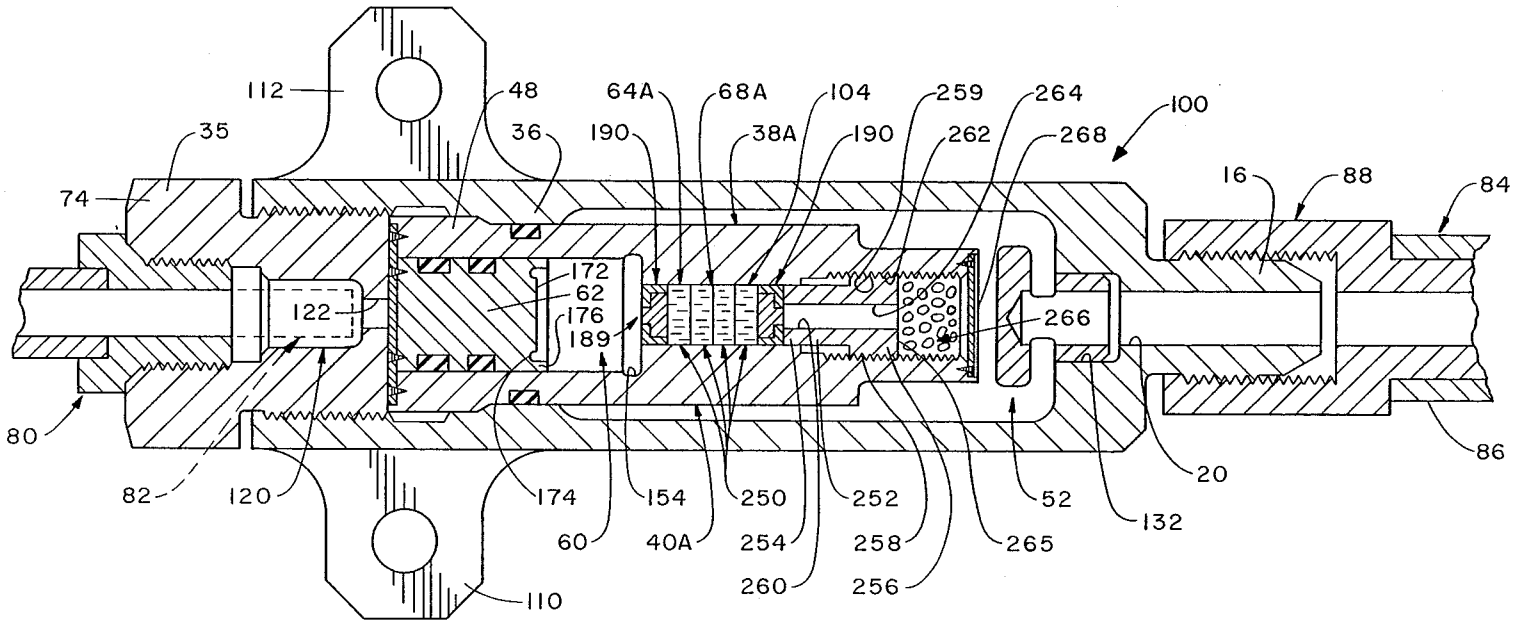
FIG. 10 is a view similar to that of FIG. 8, but illustrating the initiator device in the form of a time delay initiator.

Reference numeral 100 of FIG. 10 generally indicates a similar initiator device that is equipped with a cartridge assembly 38A having its pyrotechnic material column or charge 104 arranged for time delay characteristics. In the showing of FIG. 10, the initiator 100 is illustrated as operatively installed in aircraft or the like with the firing device 80 and hosing 84 applied thereto.

A special characteristic of the initiators 10 and 100 is that, in accordance with the present invention, the pyrotechnic column 68 or charge of the respective cartridge assemblies 38 and 102 is ignited by adiabatic compression, and by way of forcing the cartridge assembly piston 62 the length of the cartridge assembly compression chamber and to impact against the end of the cartridge body compression chamber, whereupon ignition of the pyrotechnic column begins, and the heat generated by the adiabatic compression involved is maximized, as will be described hereinafter. While air is employed in the cartridge assemblies 38 and 38A that are illustrated, cartridges 38 and 38A may be charged with any gas that, when adiabatic compression is effected as herein disclosed, produces temperatures that will ignite the pyrotechnic column 68 or its equivalent that is involved.

SPECIFIC DESCRIPTION

The initiator device housing 12, in the showing of FIGS. 1, 2 and 8, is shown to include a pair of oppositely disposed mounting lugs 110 and 112 that, as shown, extend oppositely and laterally of the housing 12 in complanar relation, and that are each formed with an aperture 114 to receive a suitable nut and bolt assembly (not shown) for fixing the initiator in its mounted relation. However, lugs 110 and 112 and their apertures 114 are considered optional features, as they can be either singly or both eliminated (as shown in FIG. 9), or be present at other locations on the housing 12, as may be necessary or desirable under the circumstances involved in the application or mounting of the initiator device 10 in an aircraft or the like. As will be clear to those familiar with this type of device, there are quite a number of applications for same where no lug or lugs comparable to lugs 110 and 112 will be required.

The head 28 of the initiator device 10 in addition to being centrally apertured to threadedly receive the plug 74, defines chamber 120 in which the explosive tip of the conventional SMDC device is received when employed, as diagrammatically illustrated in FIGS. 8 and 10. The head chamber 120 is open to its centrally located aperture 122 that is to be axially aligned with the piston 62 of the respective cartridge assemblies 38 and 102, in the initiators 10 and 100 that are illustrated, for purposes that will be made clear hereinafter.

The deflector 52 of housing 12 is formed to include cylindric stud portion 130, that prior to the application of the cartridge assembly 38 and head 28 to housing 12, is slipped into counterbore 132 that has been formed in the housing 12 in alignment with the discharge passage 20, and secured in place by a suitable adhesive sealant such as the EC 2216 product available from 3M, Inc., St. Paul, Minn. The deflector includes a barrier section 134, with the stud 130 defining a central bore 136 that communicates with the central chamber 14 through opposed grooves 138 that are disposed radially of the deflector 52 and open into the bore 136 from the sides of the deflector 52.

Referring now more specifically to the cartridge assembly 38, which is shown on an enlarged scale in FIGS. 3–6, the cartridge body 40 is formed to define cylindrical portion 140 that terminates at the body discharge end 50 and defines external cylindrical surfacing 42. In the form shown, the neck portion 46 defines frusto-conical external surfacing 44 that substantially complements the corresponding frusto-conical neck surfacing 47 on the housing internal shoulder 36. As already indicated, the external cylindrical surfacing 42 of the cartridge body 38 substantially complements the internal cylindrical surfacing 39 forming body shoulder opening 37 (of the housing internal shoulder 36) for slip fit application thereto, and against the housing shoulder 36, when the loaded or armed cartridge 38 is applied within the housing 12. The cartridge body 40 at its head end 48 defines external cylindrical surfacing 49 that substantially complements internal surfacing 51 of housing 12, and body 40 also defines annular end surfacing 150 that is in coaxial relation with the cartridge compression chamber 60.

The cartridge compression chamber 60 is coaxially disposed with respect to the cartridge body 40 and defines internal and encompassing cylindrical surfacing 152 that internally of the cartridge body 40 merges into annular internal recess 154 that is of curvilinear configuration and forms an enlarged end portion 156 of the compression chamber 60, which recess merges into annular planar land 158 that lies in a plane that extends transversely of the central axis 160 of the cartridge body 40 and is in essentially concentric relation to the pyrotechnic material receiving chamber 64.

Received in the compression chamber 60 is piston 62 that is also formed from stainless steel or the like, and defines external cylindrical surfacing 164 that substantially complements the compression chamber cylindrical surfacing 152 such that the piston 62 is free to slip fit move within the compression chamber 60 when permitted to do so. The piston 62 and its side surfacing 164 is formed to define one or more grooves 166 each equipped with the respective 0 ring seals 168, in the illustrated embodiment, which are suitably lubricated, but normally the 0 ring seals 166 and 168 and the grooves in which they are lodged are not necessary as the complementary configurations of the surfacings 152 and 164 are ordinary enough to insure that pressure gas leakage past piston 62 will be insufficient soon enough to adversely effect the adiabatic compression operation of the cartridge assembly 38.

Figure 6:
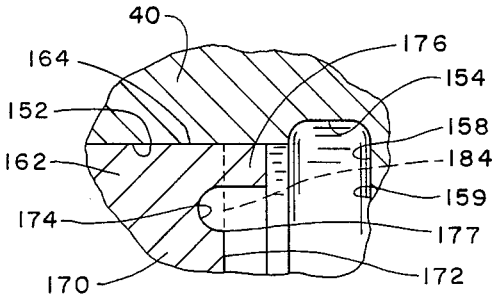
FIG. 6 is a fragmental view of the cartridge assembly body, the cartridge assembly body compression chamber, and the cartridge assembly piston, that brings out a critical feature of the present invention.

Referring now more specifically to FIGS. 3 and 6, the internal end 170 of piston 62 is formed to define a central planar land 172 that is located coaxially of the piston 62 and compression chamber 60 about which is defined annular groove or recess 174 which in turn is enclosed by annular skirt 176 with both the recess 174 and the skirt 176 being coaxially related to the compression chamber 60 and the piston 62. Land 172 thus defines a circular perimeter 177 that lies radially inwardly of recess 174.

In accordance with the present invention, the piston 62 is frangibly secured in its retracted relation within compression chamber 60 and to the cartridge body 40. In the illustrated embodiment, this is effected by a metallic disc 175 that is seated in recess 178 that is formed concentric to end surfacing 150 of the cartridge body 40, and stitch welded to both the cartridge body 40 and the piston 62 where indicated at 180 and 182 in FIG. 4. Disc 175 is preferably formed from stainless steel or its equivalent and is of film thickness proportions (0.002 inch in the illustrated embodiment).

As has been previously pointed out, the cartridge assembly 38 is to effect ignition, by adiabatic compression, of the conventional pyrotechnic materials that form column 68 thereof. For this purpose, when the initiator device 10 is mounted as indicated in FIG. 8 and has the conventional SMDC detonating device applied thereto, as indicated in FIG. 8, when the initiator device 10 is to be put into operation, the SMDC detonating device is suitably energized to explode its conventional tip 82. This has the effect of the explosive forces involved pressing through housing 122 and fracturing the disc 175 in conformity with the cylindrical internal surface 152 of compression chamber 60 and also forcing the piston 62 toward the annular cartridge body land 158 with great kenetic energy, to the extent that the piston land 172 impacts forcefully against cartridge body land 158, and a portion of the piston 62 making up the annular skirt 176 will be forced into both the cartridge body annular recess 156 and the piston annular recess 174, locking the piston 62 to cartridge body 40. The adiabatic compression of the air within the compression chamber 60 that is trapped between the piston end 170 and housing land 158 so heats such air that when the piston land 172 is impacted against the land 158 of the cartridge body 40 and the deflection mentioned of the piston 62 has taken place, the air that has been so compressed will have its temperature raised well beyond the ignition point of the pyrotechnic materials lodged in the pyrotechnic material receiving chamber 64 (of the cartridge body 40 at the head end of column 68). The impacting of piston 62 against housing land 158 that has been referred to also results in the piston 62 being locked in its extended relation with compression chamber 60. In a successful initiator arranged in accordance with the piston 62 has a forced travel length from the position of FIGS. 1 and 3 to impact against land 158 of approximately 0.800 inch, for example; while the length of travel of the piston 62 in its compression chamber 60 may thus be relatively short, the unbalanced force acting on the piston 62 and the gas with which chamber 60 is charged must be the proper combination that, by adiabatic compression, cause ignition of the pyrotechnic column 68 at its end.

The same result is effected by connecting initiator device 10 to a source of neutral gas under high pressure, as suggested by the diagrammatic showing of FIG. 9.

Figure 3A:
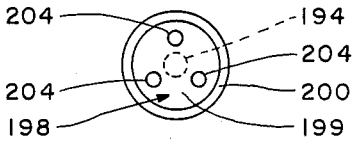
FIG. 3A is a view of an aperture or ported back up screw element that forms an important part of the pyrotechnic column of the cartridge assembly of FIGS. 1 and 3, as arranged for adiabatic compression ignition.
Figure 4:
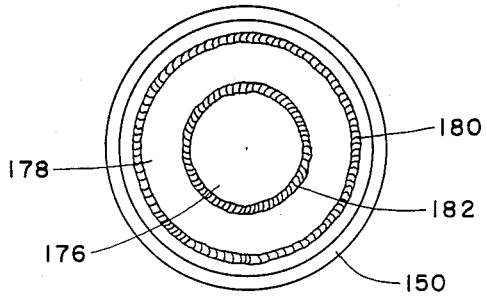
FIG. 4 is an elevational view of the left hand end of the cartridge assembly of FIG. 3.
Figure 5:
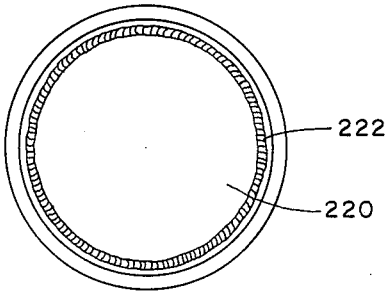
FIG. 5 is an elevational view of the right hand end of the cartridge assembly of FIG. 3.
Figure 7:
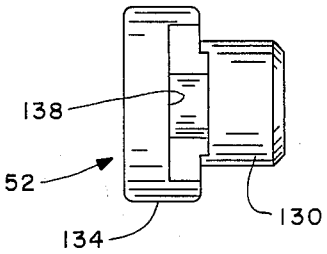
FIG. 7 is a view of the propellant gas deflector that is part of the initiator housing assembly shown in FIG. 1.

In order to take advantage of this adiabatic compression result of the present invention and the relatively safe ignition of the pyrotechnic materials that are involved, the pyrotechnic materials forming a pyrotechnic column 68 of the illustrated embodiment of cartridge assembly 38, and the shaping of its chamber 64 can be arranged, for example, as follows for achieving short time span ignition of the pyrotechnic column 68:

At the head 189 of the pyrotechnic column 68 (see FIG. 3) is a combination ignition powder-aluminum cup device 190 that comprises a conventional aluminum firing cup 192 that is centrally apertured as at 194, and receives a body 196 of a suitable ignition powder, which may be of the A-1A type (as per MIL-P-22264, this powder is a mixture of Zirconium, ferric iron oxide and diatomacous earth). A disc 197 formed from a suitable readily ignitable filter paper is placed against and closes off the device 190, and seated against the disc 196 is the threaded metallic body 198 (which also may be formed from stainless steel or the like; see FIG. 3A) that is externally threaded as at 200 for threaded application to the internal threading 202 formed in the cartridge body 40 at the area of the pyrotechnic chamber 64 where the screw threaded body 198 is to be applied. The screw threaded body 198 is shown in end elevation in FIG. 3A and is preferably formed with several through passages 204 (three in the illustrated embodiment) that are out of alignment with the aperture 194 of the cup 192, as indicated in FIG. 3A.

In connection with the assembly of the cartridge assembly 38, it is important that the end surfacing 193 of the cup 192 be disposed in coplanar relationship with the plane 159 of annular land 158 of the cartridge body 40, and for this purpose, prior to the application of piston 62 to compression chamber 60, the cup device 190 and threaded body 198 are applied to the cartridge body, with the threaded body 198 being rotated, as by employing a suitable tool applied to several of the apertures 204, as needed to dispose the end surfacing 193 of the cup 192 in coplanar relationship with the cartridge body land 158 (and its plane 159).

When this has been achieved, the apertures 204 are filled with finely particulate powder 203 which is also applied over the end surfacing 199 of the body 198, where indicated at 205, against which is applied a disc 206 (formed from a suitable readily igniteably material, such as conventional onion skin paper).

It may be here pointed out that the spaced orientation of the threaded body apertures 204 relative to the centrally located aperture 194 of the cap 192 is to insure an other than rectilinear or straight line explosive energy flow path so that ejection of a portion of the firing powder involved through one or more of the apertures 204 to the right of FIG. 3 without being ignited, will be not possible.

The specific pyrotechnic chamber 64 illustrated in FIGS. 1 and 3 is enlarged as at 210 to form a subchamber 211 that receives ignition powder that comprises either black powder or its equivalent, which is held in place within the subchamber 211 by stainless steel disc 212 that is tack welded (welded at 4–6 spaced apart locations about the circumference of disc 212, since a hermetic seal is not required at this location) to the cartridge body 40 over the subchamber 211, with the disc 212 being of film dimension proportions (0.002 inch in the illustrated embodiment) for ready outward displacement when the pyrotechnic materials involved are ignited.

The illustrated pyrotechnic chamber 64 is completed by another enlargement 214 formed in the cartridge body 40 to define the relatively large subchamber 216 in chamber section 66 in which the propellant output charge 70 is disposed, and closed off by output disc 220 formed from stainless steel that is stitch welded as at 222 to the end 142 of the cartridge body 40 to provide a hermetic seal at this location. Disc 220 is also of film dimension thickness proportions (0.002 inch in the illustrated embodiment) for ready outward displacement when the propellant output charge 70 ignites.

The propellant charge 70, as well as its ignitor mixes referred to, as is well known to the art, may be tailored to meet the needs for which a specific initiator device 10 having a specific cartridge assembly 38 are to be applied, with the chamber 64 of the cartridge assembly involved being shaped accordingly. For instance, the propellant 70 may be a single or double base propellant, or a propellant that is a suitable composite of both bases.

The cartridge body 40 is shown to be externally grooved as at 230 adjacent neck 44 to receive a suitable O ring seal 232 for sealing purposes; seal 232 is generally required where the output of a cartridge assembly 38 is of the gas producer type. Seal 232 and its groove 230, for some applications can be eliminated, if the complementary but slip fit proportions that have been mentioned are observed for the parts involved, and the output is to be of the explosive type.

As indicated, cartridge assemblies 38 are preferably assembled separately from the housings 12 therefor, with each housing 12 having applied to same a cartridge assembly 38 that has its pyrotechnic column 68 made up to perform a specific function or functions for which the initiator device 10 is designed to handle. The new initiator device 10 that results has a plug 74 and closure fitting 76 applied to same for packaging and shipping purposes, and when the initiator device 10 in question is to be mounted in its operative dormant position for serving as a means for activating emergency equipment of aircraft and the like, the plug 74 and end fitting are removed, and, for instance, a conventional explosive device 80 and a conventional conduiting coupling 88 are applied thereto in the manner indicated in FIG. 8, which readies initiator device 10 for use if and when needed. As has been indicated, the lugs 110 and 112 and their associated parts for many applications may be omitted, or formed elsewhere as a particular installation requires; where present, they are suitably bolted or otherwise secured in place.

When use of the emergency equipment is required, the firing device 80 is actuated to, for instance, explode its explosive tip, which fractures the disc 175 about the rim of the compression chamber 60 defined by internal surfacing 152 and drives the piston 62 against the cartridge body land 158 to achieve the adiabatic compression that has been indicated, which effects ignition of the pyrotechnic materials that have been applied to a particular cartridge assembly 38; in the cartridge assembly 38 that is illustrated in connection with the embodiment of FIGS. 1–9, ignition is through the aperture 194 of cup 93, and thence through ignitable disc 196, the particulate ignitable powdered material within apertures 204 and overlying the face 199 of threaded body 198, whereby the ignitable disc 206 is ignited together with the following ignition of the ignitable mass within subchamber 211, which results in the displacement of disc 212, ignition of the propellant charge 70, and the resulting generation (in the specific cartridge 38 illustrated) of high pressure gas within the subchamber 214, that in turn results in outward displacement of the disc 220 from the cartridge body 40, and the outpour of high pressure gases from the cartridge body through the deflector 52, the housing port or outlet passage 20 and thence through conduiting 84 to the emergency equipment to be actuated. Deflector 52 acts as a filter since it avoids blockage of housing passage 20 by fragments of discs 212 and 220 that may result on ignition of pyrotechnic column 68 (or its equivalent; discs 212 and 220 normally melt under the heat that is generated by the ignition involved).

The same adiabatic compression ignition results when the initiator device 10 is to be actuated by the source of high pressure gas, as suggested by the showing of FIG. 9. This, of course, involves the valve 83 being incorporated in a suitable and conventional control system that, when actuated, effects turning off-on valve 83 of high gas pressure line 81 to the "on" position (electrically or otherwise) so that high pressure gas can pass through suitable fitting 227 (that has been previously applied to head 28 for this purpose) and aperature 122 to fragment disc 175 and actuate piston 62 as already described.

Where the pyrotechnic materials of a pyrotechnic column 64 are to have a time delay effect, a cartridge assembly 38A of the general type shown in FIG. 10 is employed in connection with a housing 12A proportioned to accept the modified cartridge assembly 38A that is involved (see FIG. 10).

As made clear by the showing of FIG. 10, the cartridge body compression chamber 60, piston 62, the cartridge head 48, the cartridge piston land 172, the piston recess 174, the piston skirt 176, and the cartridge body recess 154 and land 58, are the same as in the embodiment of FIGS. 1 and 8. The cartridge body pyrotechnic chamber 64A is modified in the manner indicated in FIG. 10, in light of the time delay pyrotechnic materials to be employed, the body 40A being formed to receive a pair of inverted cup powder devices 190 that are separated by a plurality of time delay ignitor composition bodies 250 of any suitable type; also employed is the elongated metallic screw member 252 having an end portion 254 seated against the discharge end device 190 and its other end portion 256 externally screw threaded as at 258 for threaded connection with the internal screw threading 259 of the cartridge body 40A (of the modified cartridge assembly). The metallic body 252 (which preferably is formed from stainless steel or its equivalent) is shaped to define an elongate central passage 260 and a screwdriver blade receiving cross slot 262 having end portion 264 of bore 260 at the slotted end 265 (of body 252), against which the propellant charge 266 is seated that is held in place by a metallic disc 268 (that is equivalent to disc 220 of the cartridge assembly 38) and that is affixed to the discharge end of the cartridge body 40A involved by stitch welding or the like to provide the aforementioned hermetic seal, with disc 268 displacing on ignition of charge 266, as in the case of disc 220. Note that one of the devices 190 is at the head end 189 of pyrotechnic column 68A.

Initiator devices 100 that include a time delay cartridge assembly 38A may be equipped as indicated in FIG. 1 for shipping and packaging purposes, and are equipped as indicated in FIGS. 8 or 9 for actuation of initiator device 100 if and when needed.

From what has been disclosed, it will be apparent that the input into a specific cartridge assembly 38 or 38A may be either explosive (FIG. 8) or by way of gas (such as air) under adequate pressure (such as the indicated 400 psig). The time of action of the cartridge pyrotechnic column may be of short (FIG. 8) or of time delay (see FIG. 10) relation. The cartridge output will depend on the cartridge pyrotechnic column employed, and thus may involve gases under pressure or explosive forces that are directed to the equipment to be actuated by tubular hosing or the like.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A pyrotechnic material actuated initiator device for activating emergency equipment, said initiator device comprising:

a housing defining a central chamber of cylindric configuration having a discharge bore at one end of same and being open at the other end of same, said housing defining an annular shoulder about said chamber adjacent said other end of said housing, a pyrotechnic cartridge mounted in said chamber, said cartridge including:

a body having a head portion adjacent one end of same for seating against said annular shoulder and being chambered adjacent the other end of same for mounting pyrotechnic material means in a pyrotechnic column having a head facing said body one end, said body adjacent said one end of same defining a cylinder aligned with the pyrotechnic column head and having a piston mounted in said cylinder in close fitting relation thereto adjacent said one end of said body, said cylinder being proportioned lengthwise thereof to define a piston stroke toward and against the pyrotechnic column head end, means for spacing the pyrotechnic column head end from said piston at the end of the piston stroke when effected, and a head secured in said other end of said body and against said head portion of said cartridge body for biasing said cartridge body against said housing shoulder for centering said cartridge body in said housing and directing said cartridge other end toward said housing discharge bore, said head having a bore therethrough directed at said piston, and means for acting through said head bore for effecting thrust of said piston toward said pyrotechnic material head end to effect adiabatic compression ignition of same for initiating discharge from said housing discharge bore.

2. The initiator device set forth in claim 1 wherein:

said effecting means compresses on explosive type firing device removably mounted in said head bore.

3. The initiator device set forth in claim 1 wherein:

said effecting means comprises means for connecting said head bore to a source of gas under a pressure of at least four hundred psig.

4. The initiator device set forth in claim 1 including:

a deflector mounted in said housing chamber between said housing discharge bore and said cartridge body other end for avoiding clogging of said bore.

5. The initiator device set forth in claim 1 wherein:

said housing defines adjacent said one end of same a reduced portion through which said discharge bore extends, said housing reduced portion being externally threaded for threaded connection to an internally threaded end fitting of hosing for conveying the gas generated by said propellant away from said housing.

6. A pyrotechnic cartridge assembly for application to an initiator for activating emergency equipment, said cartridge assembly comprising:

a cylindric metallic body defining a compression chamber adjacent one end of same and a pyrotechnic charge receiving chamber adjacent the other end of same, said compression chamber having a piston received in same at said one end of said body in slip fit relation to said compression chamber, said body short of said pyrotechnic chamber defining an annular recess thereabout and an annular land that is disposed transversely of said compression chamber and forms the inner end of said compression chamber, pyrotechnic material means mounted in said pyrotechnic material receiving chamber substantially along the length of same defining a pyrotechnic column having its head end in substantially planar relation to said body annular land, closure means secured to said body other end for retaining said pyrotechnic column in said pyrotechnic material receiving chamber, said closure means comprising a disc of film thickness proportions for displacement on ignition of said pyrotechnic column, said compression chamber between said annular recess and said one end of said body defining a piston travel length portion of uniform dimensions transversely of said compression chamber, said said piston being in complementary fit relaetion with said piston travel length portion of said chamber, and said piston being frangibly anchored to said body at said one end of said body and within said compression chamber, said piston defining opposite end portions including an inner end portion disposed within said compression chamber and facing said annular land of said body, with said piston inner end defining:

a marginal annular skirt extending thereabout and longitudinally of said body, a substantially planar land surfacing that extends transversely of said piston, and an annular groove separating said piston land and said piston skirt, said groove and skirt being of uniform dimensions three hundred sixty degrees thereabout, whereby when said piston is forced to travel the length of said chamber piston travel length portion and impacts said land thereof against said body land, an adiabatic compression stroke of same within said chamber has been completed and effects igniting of said pyrotechnic column at said head end of same, for creating initiator pressure that ruptures said disc.

7. The cartridge assembly set forth in claim 6 wherein:

the volume of said piston defining said skirt thereof approximates the volume of said body annular recess plus the volume of said piston annular groove.

8. The cartridge assembly set forth in claim 7 wherein:

the volume of said piston defining said skirt is deflected into said body recess and said piston groove at the end of said adiabatic compression stroke and said piston inner end is keyed to and against said body annular land.

9. A pyrotechnic material activated gas generating initiator device for activating emergency equipment, said iniator device comprising:

a housing of cylindric configuration defining a central chamber having a discharge bore at one end of same and being open at the other end of same, said housing defining an annular shoulder about said chamber adjacent said other end of said housing, a pyrotechnic cartrige mounted in said chamber, said cartridge comprising:

a cylindric metallic body defining a compression chamber adjacent one end of same and a propellant charge receiving chamber adjacent the other end of same, said body one end defining a head portion for seating against said housing annular shoulder, said compression chamber having a piston received in same at said one end of said body in slip fit relation to said chamber, said body short of said propellant chamber defining an annular recess thereabout and an annular land that is disposed transversely of said compression chamber and forms the inner end of said compression chamber, said body between said compression chamber and said propellant chamber defining a pyrotechnic material receiving chamber, pyrotechnic material means mounted in said pyrotechnic material receiving chamber forming a pyrotechnic column substantially along the length of same having a head end, a propellant charge mounted in said propellant chamber, closure means secured to said body other end for retaining said propellant charge in said propellant chamber, said closure means comprising a disc of film thickness proportions for rupturing on ignition of said propellant and generation of pressure thereby, said compression chamber between said annular recess and said one end of said body defining a piston travel length position of uniform dimensions transversely of said compression chamber, with said piston being in complementary fit relation with said piston travel length portion of said chamber, and said piston being frangibly anchored to said body at said one end of said body and within said compression chamber, said piston defining opposite end portions including an inner end portion disposed within said compression chamber and facing said land of said body, with said piston inner end defining:

a marginal annular skirt extending thereabout and longitudinally of said body, a substantially planar land surfacing that extends transversely of said piston, with said head end of said pyrotechnic column being in substantially coplanar relation with said body land surfacing, and an annular groove separating said land and said skirt, said groove and skirt being of uniform dimensions three hundred sixty degrees thereabout, and a head secured in said other end of said housing and against said body head portion for biasing said cartridge body against said housing shoulder for centering said cartridge body in said housing and directing said cartridge other end toward said housing discharge bore, said head having a bore therethrough in communication with the piston outer end portion, and means for acting through said head bore for effecting thrust of said piston toward said pyrotechnic column head end to effect adiabatic compression ignition of same, for initiating pressure discharge from said housing discharge bore.

10. The initiator device set forth in claim 9 including:

a propellant gas deflector mounted in said housing chamber between said housing discharge bore and said cartridge body other end.

11. The initiator device set forth in claim 9 wherein:

said housing defines adjacent said one end of same a reduced portion through which said discharge bore extends, said housing reduced portion being externally threaded for threaded connection to an internally threaded end fitting of hosing for conveying the gas generated by said propellant away from said housing.

12. The initiator device set forth in claim 9 wherein:

the volume of said piston defining said skirt thereof approximates the volume of said body annular recess plus the volume of said piston annular groove.

13. The initiator device set forth in claim 12 wherein: the volume of said piston defining said skirt is deflected into said body recess and said piston groove at the end of said adiabatic compression stroke and said piston inner end is keyed to and against said body annular land.

14. The initiator device set forth in claim 9 wherein said pyrotechnic material means is of the short duration type.

15. The initiator device set forth in claim 9 wherein said pyrotechnic material means is of the time delay type.

* * * * *